US006969272B2

(12) United States Patent
Sakamoto et al.

(10) Patent No.: US 6,969,272 B2
(45) Date of Patent: Nov. 29, 2005

(54) PRESSURE WELDING CONNECTING TERMINAL AND PRESSURE WELDING CONNECTOR RECEIVING THE SAME

(75) Inventors: Nobuyuki Sakamoto, Shizuoka (JP); Takashi Muro, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/911,549

(22) Filed: Aug. 5, 2004

(65) Prior Publication Data

US 2005/0029325 A1 Feb. 10, 2005

(30) Foreign Application Priority Data

Aug. 8, 2003 (JP) ..... 2003-290556

(51) Int. Cl.[7] ..... H01R 11/20
(52) U.S. Cl. ..... 439/397; 439/404
(58) Field of Search ..... 439/397–399, 439/404, 719–720, 395; 228/3.1

(56) References Cited

U.S. PATENT DOCUMENTS 5,415,562 A * 5/1995 Matsumoto et al. ..... 439/397
5,554,046 A * 9/1996 Sugiyama et al. ..... 439/397
5,707,243 A * 1/1998 Endo et al. ..... 439/76.2
6,428,364 B2 * 8/2002 Saito et al. ..... 439/736
6,692,290 B2 * 2/2004 Yamanashi et al. ..... 439/397

FOREIGN PATENT DOCUMENTS

| | | |
|---|---|---|
| JP | 6-203643 | 7/1994 |
| JP | 6-203888 | 7/1994 |
| JP | 11-40214 | 2/1999 |

* cited by examiner

*Primary Examiner*—Michael C. Zarroli
(74) *Attorney, Agent, or Firm*—Armstrong, Kratz, Quintos, Hanson & Brooks, LLP

(57) ABSTRACT

In a pressure welding connecting terminal, a wide plate part 15*a* is formed at one side of a base plate 15 while a narrow plate part 15*b* that leads to the wide plate part 15*a* is formed at the other side of the base plate 15, an electric contact 17 is formed being bent integrally with the wide plate part 15*a*, and an electric wire-pressure welding part 22 is formed integrally with the narrow plate part 15*b*. The electric wire-pressure welding part 22 includes: a folded part 23 projectingly formed on a side surface 15*c* of the base plate 15 and folded in a U-turn-shape; a narrow connecting part 24 leading to the folded part 23 and piled on the base plate 15; a wide pressure welding piece 25 leading to front and rear ends of the connecting part 24 and bent to rise up perpendicularly to the base plate 15; and a leg part 26 projectingly formed at a lower part of the pressure welding piece 25 so as to support the pressure welding piece 25 when an electric wire is press-fit thereinto.

6 Claims, 4 Drawing Sheets

PRESSURE WELDING CONNECTING TERMINAL AND PRESSURE WELDING CONNECTOR RECEIVING THE SAME

BACKGROUND OF THE INVENTION (1) Field of the Invention

The present invention relates to a pressure welding connecting terminal, which is electrically connected to a core wire of an electric wire that includes an electrically insulating coating on an outer circumference of the core wire, the insulating coating being cut when the electric wire is press-fit into a slot of a pressure welding piece, and to a pressure welding connector that receives the pressure welding connecting terminal therein.

(2) Description of the Related Art

FIG. 7 shows an example of a conventional pressure welding connecting terminal and a pressure welding connector that receives the pressure welding connecting terminal therein (Japanese Patent Application Laid-Open No. H6-203888).

In this conventional example, a connector housing 56 is provided with a hollow part 57 and a pressure welding connecting terminal 50 is provided with a step 54*b* and wire-fixing part 54, which engage with the hollow part 57, so that an electric wire 60 never comes out from the pressure welding connecting terminal 50 even if a tension is applied thereon, thereby the electric wire 60 is securely held without using an external component such as a holding member.

The pressure welding connecting terminal 50 is formed by stamping out from an electrically conductive plate and by being bent. The pressure welding connecting terminal 50 includes a female electric contact 51 having a rectangular cylindrical shape at one side thereof and a wire-pressure welding part 52 and wire-fixing part 54 at the other side. A resilient contact piece (not shown) is provided in the electric contact 51 and a male terminal (not shown) of a mating connector is inserted into the electric contact 51 from a hole (not shown) in a front wall 58*b* of the connector housing 56 made of synthetic resin.

The wire-pressure welding part 52 (hereinafter, pressure welding part 52) includes a pair of side walls 52*a*, each rising up vertically from both sides of a horizontal base plate 53, and respective pairs of pressure welding pieces 52*b*, each pair being bent inwardly at the front and rear ends of the side wall 52*a*. A slot 53*c* for pressure-welding the wire is formed between the pair of the pressure welding pieces 52*b*. An insulating coating of the electric wire 60 is cut by a blade situated at an upper end of each pressure welding piece 52*b*. A core wire of the electric wire 60 is press-fit into the slot 52*c*, so that the wire 60 is connected to the pressure welding connecting terminal 50.

The wire-fixing part 54 situated at the rear of the pressure welding part 52 includes a pair of crimp pieces 54*a* formed alternately, which caulks the circumference of the coating of the wire 60 so as to fix the wire 60. Since the pressure welding part 52 is thin, its strength is small. Therefore, the pressure welding part 52 might be inclined or deformed depending on a tension of the wire 60, however, since the wire-fixing part 54 fixes the wire 60, the pressure welding part 52 is prevented from being inclined.

The pressure welding connecting terminal 50 is inserted into a terminal-receiving groove 59 of the connector housing 56 from above and engaged with an engaging projection 59*a*. Under such a condition, the wire 60 is pressure-welded to the pressure welding part 52 from above. This pressure welding is carried out in a manner that the wire 60 is press-fit from above with a press-fitting blade (i.e. jig) keeping away from the pressure welding piece 52*b*. In comparison with the crimping, the pressure welding has an advantage that it saves a time-consuming work because it does not need a work of peeling the insulating coating.

The terminal-receiving groove 59 of the connector housing 56 is surrounded by left and right partition walls 58*a* (only one of them being shown in the figure), side wall 58*c* and front wall 58*b*. The connector housing 56 is received in a casing (not shown in the figure), thereby an upper opening of the terminal-receiving groove 59 is covered. A pressure welding connector 55 is constituted by at least the connector housing 56 and the pressure welding connecting terminal 50.

The pressure welding piece 52*b* of the pressure welding connecting terminal 50 is formed integrally with the side wall 52*a*. In contrast, in FIG. 8, there is shown a pressure welding connecting terminal 65 which includes a pressure welding piece 67*c* having no side wall. In this pressure welding connecting terminal 65, folding part 67*a* formed on a side of a base plate 66 is folded by an angle of 180° in a U-turn-shape, then a connecting part 67*b* that leads to the folding part 67*a* is piled on the base plate 66 and then, the pressure welding piece 67*c* formed at an end of the connecting part 67*b* is bent inwardly by an angle of 90°, thereby forming a pressure welding part 67.

As another conventional example (not shown), a pressure welding connecting terminal has been proposed (Japanese Patent Application Laid-Open No. H6-203643 and Japanese Patent Application Laid-Open No. H11-40214), in which a pressure welding part made of metal is formed separately from a base plate, a notched part is formed on a base plate or side wall, and the pressure welding part is engaged with the notched part so as to be fixed.

However, the conventional pressure welding connecting terminal 50, 65 described above has the following problem.

In the first conventional example (FIG. 7), the pressure welding piece 52*b* leads to the side wall 52*a* that rises up vertically from both sides of the horizontal base plate 53, therefore the rising-up posture of the pressure welding piece 52*b* is stabilized so as to prevent the pressure welding piece 52*b* from being inclined in a direction of its thickness upon press-fitting of the wire. However, on the other hand, the thickness of the wide wall 52*a* is included into the width dimension of the pressure welding connecting terminal 50, causing an increase in the width of the pressure welding connecting terminal 50. If the width of the pressure welding connecting terminal 50 is large, the width of the terminal-receiving groove 59 of the connector housing 56 that receives the pressure welding connecting terminal 50 therein becomes large, causing difficulty in making the pressure welding connector 55 compact. Particularly, as for a multipolar connector, a demand for making the connector compact has been strong.

In FIG. 8, when the folding part 67*a* is short, the connecting part 67*b* that leads to the folding part 67*a* is piled on the base plate 66 being displaced. However, if the folding part 67*a* is made long, it causes a problem that the folding part 67*a* is forced out toward the outside in the width direction of the base plate 66.

In the other conventional example described above, the pressure welding part is formed separately from the base plate. Since there is the side wall that rises up perpendicularly from the side of the base plate similarly to the first conventional example, there has been a problem that the width dimension of the pressure welding connecting terminal becomes large and a problem that the number of the components is increased, causing a cost-up of the components.

SUMMARY OF THE INVENTION

It is therefore an objective of the present invention to solve the above problems and to provide a pressure welding connecting terminal, by which the width dimension of the wire-pressure welding part is made to be small so that the connector can be made compact and the pressure welding piece can be prevented from buckling or being inclined upon press-fitting of the electric wire, and a pressure welding connector that receives such a pressure welding connecting terminal therein.

In order to attain the above objective, the present invention is to provide a pressure welding connecting terminal, which integrally includes an electric wire-pressure welding part at least at one side of the terminal in a longitudinal direction of a base plate of the terminal, the electric wire-pressure welding part including:

a folded part projectingly formed on a side surface of the base plate and folded in a U-turn-shape;

a narrow connecting part leading to the folded part and piled on the base plate;

a wide pressure welding piece leading to at least one of a front end and a rear end of the connecting part and bent to rise up perpendicularly to the base plate; and a leg part projectingly formed at a lower part of the pressure welding piece so as to support the pressure welding piece when an electric wire is press-fit thereinto.

With the construction described above, since the electric wire-pressure welding part is formed integrally with the base plate, the pressure welding connecting terminal can be produced by stamping out from an electrically conductive plate and bending. Therefore, the number of the components decreases and the cost of the components can be reduced. The folded part is folded by an angle of 180° in the width direction of the base plate, then the connecting part is piled on the base plate and then, the wide pressure welding piece that leads to the end of the connecting part is bent by an angle of 90° so as to be raised up from the base plate, thereby the electric wire-pressure welding part is formed integrally with the base plate. Since the connecting part is formed narrow, the folded part can be formed long. The leg part projectingly formed at the lower part of the pressure welding piece is placed on the side of the base plate when the connecting part is piled on the base plate. When the electric wire is press-fit, an end of the leg part abuts, for example, against a wall of the connector housing, thereby the leg part supports the pressure welding piece.

Therefore, the connecting part can be prevented from being piled on the base plate on its undesirably displaced condition. The width of the electric wire-pressure welding part can be formed narrow. The connector that receives the pressure welding connecting terminal therein can be formed compact. The pressure welding piece can be prevented from being deformed, such as being inclined.

Preferably, the base plate includes a wide plate part and a narrow plate part, and the electric wire-pressure welding part is formed on the narrow plate part.

With the construction described above, the folded part folded from its spreading condition can be located in a step between the wide plate part and the narrow plate part. Since the folded part is formed in the narrow plate part, the folded part can be formed long. Therefore, the folded part can be prevented from being forced out toward the outside of the base plate. The width of the pressure welding connecting terminal can be formed narrow. The connector that receives the pressure welding connecting terminal therein can be formed compact.

Preferably, the projection length of the leg part is approximately twice as large as a thickness of the base plate.

With the construction described above, since the pressure welding piece is supported by the leg part, the rising-up posture of the pressure welding piece is stabilized and the pressure welding piece is not inclined when the electric wire is press-fit. Therefore, the pressure welding piece can be prevented from being deformed when the electric wire is press-fit.

Preferably, an inner side surface of the leg part abuts against the side surface of the base plate.

With the construction described above, when the electric wire is press-fit or after the electric wire is press-fit, the inner side surface of the leg part abuts against the side surface of the base plate so as to prevent the slot of the pressure welding piece from opening. Therefore, the reliability of preventing the core wire from coming out and the reliability of the pressure welding connection can be maintained.

In order to attain the above objective, the present invention is to provide a pressure welding connector including:

the pressure welding connecting terminal described above; and a connector housing for receiving the pressure welding connecting terminal.

With the construction described above, since a small pressure welding connecting terminal can be used, the width of the groove for receiving the terminal of the connector housing can be set narrow. Therefore, the connector can be formed compact.

Preferably, both outer side surfaces of the pressure welding piece of the pressure welding connecting terminal abut against a partition wall of a groove for receiving the terminal.

With the construction described above, since both sides of the pressure welding piece abut against the partition wall of the groove for receiving the terminal, when the electric wire is press-fit or after the electric wire is press-fit, the pressure welding piece can be prevented from opening in its width direction, thereby the core wire of the electric wire securely comes in contact with the inner side surface of the slit. Therefore, the reliability of the electric connection between the electric wire and the pressure welding connecting terminal can be improved.

DESCRIPTION OF THE PREFERRED EMBODIMENTS

In the following, the preferred embodiments of the present invention will be explained in detail with reference to the attached drawings.

Figure 5:
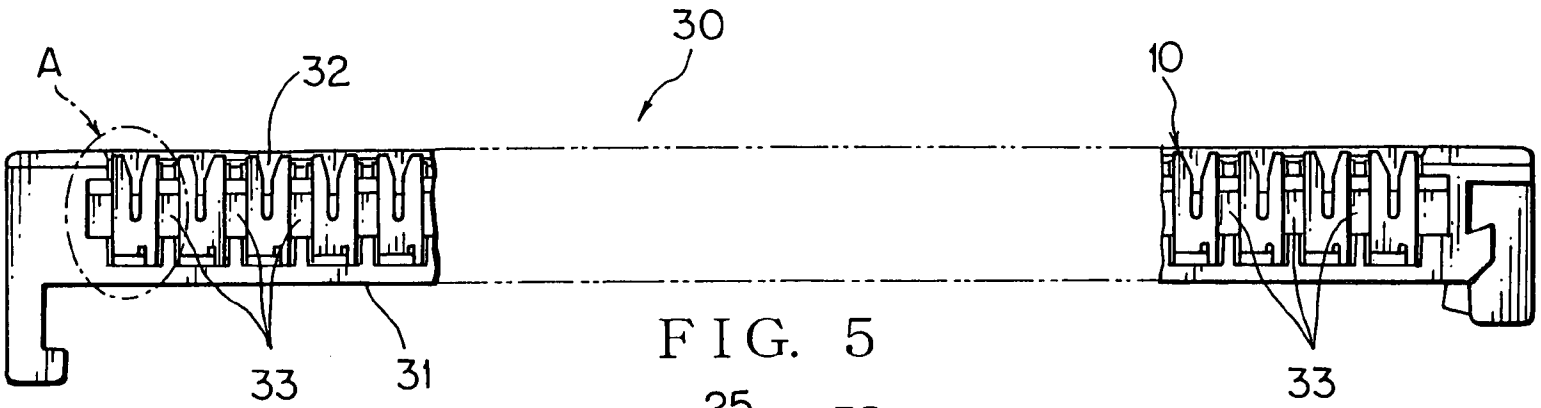
FIG. 5 is a front view illustrating a preferred embodiment of a protector according to the present invention.
Figure 6:
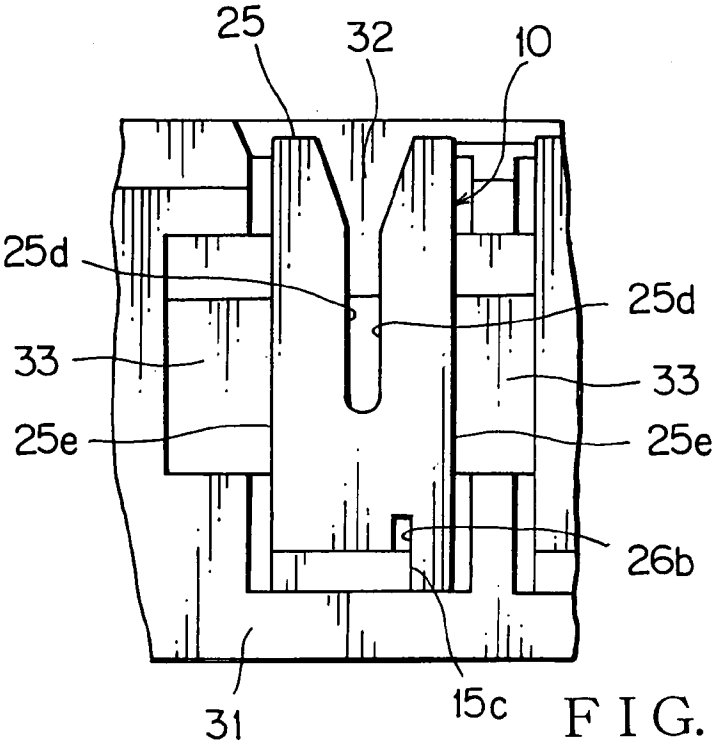
FIG. 6 is an enlarged view of a portion A shown in FIG. 5.
Figure 7:
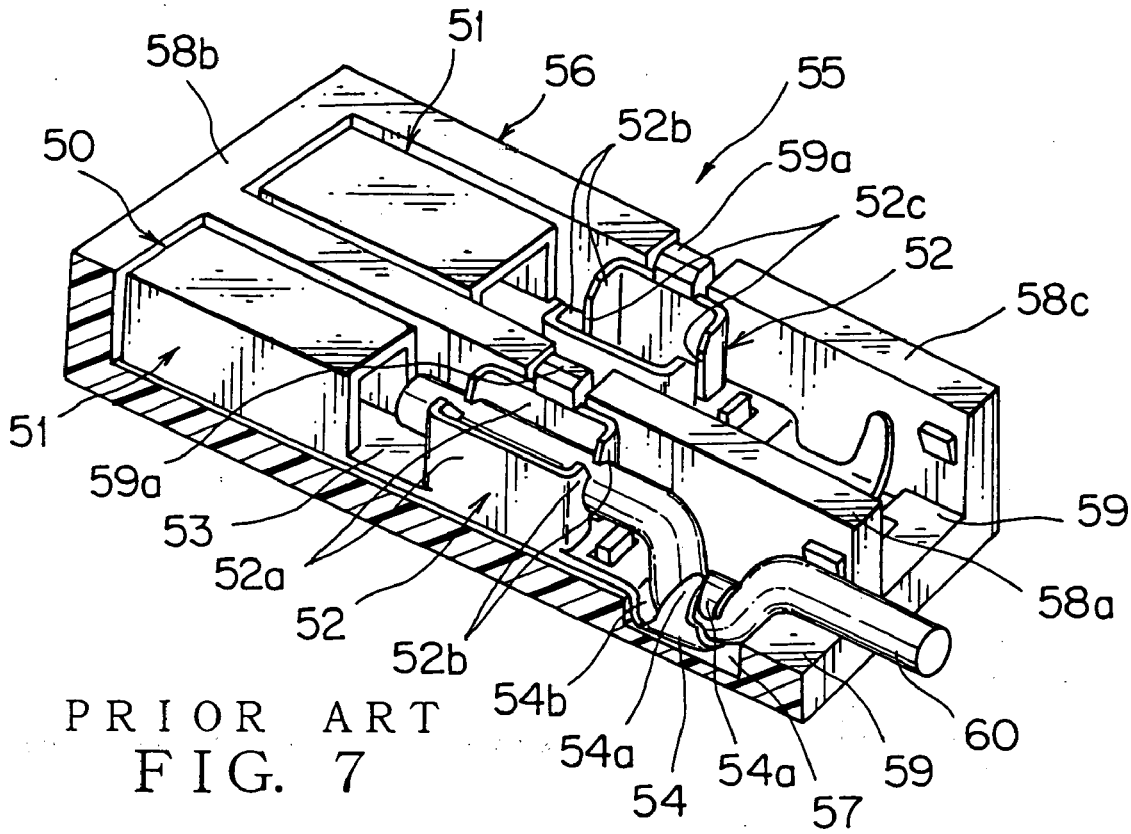
PRIOR ART FIG. 7
FIG. 7 illustrates an example of a conventional pressure welding connecting terminal.

FIGS. 1–4 show a preferred embodiment of a pressure welding connecting terminal according to the present invention. FIGS. 5 and 6 show a preferred embodiment of a pressure welding connector, in which the pressure welding connecting terminals according to the present invention are used.

The pressure welding connecting terminal (hereinafter, pressure welding terminal) 10 is a terminal fitting, which is electrically connected to a core wire 35*b* of an electric wire 35, an insulating coating 35*a* of which is cut, when the electric wire 35 having the insulating coating 35*a* on the outer circumference of the core wire 35*b* is press-fit into a slot 25*a,* which consists of a tapered shaped blade 25*b* (FIG. 4) having an opening at an end thereof and a narrow longitudinal groove 25*c* (FIG. 4) that leads to the blade 25*b*. A pressure welding connector 30 is an electric connection component consisting of a connector housing 31 having a terminal-receiving groove 32 and a pressure welding terminal 10 to be received in the terminal-receiving groove 32.

According to the pressure welding terminal 10 of the preferred embodiment, the connecting part 24 that leads to the folded part 23 is prevented from piling on the base plate 15 in its undesirably shifted condition and the folded part 23 is prevented from being forced out toward the outside of the base plate 15 in the width direction thereof, so that the width of an electric wire-pressure welding part 22 can be formed small and the pressure welding connector 30 can be formed compact, and a pressure welding piece 25 can be-prevented from being deformed, such as from buckling or being inclined upon press-fitting of the electric wire. A wide plate part 15*a* is formed at one side of the base plate 15 while a narrow plate part 15*b* that leads to the wide plate part 15*a* is formed at the other side of the base plate 15, an electric contact 17 is formed being bent integrally with the wide plate part 15*a,* and an electric wire-pressure welding part 22 is formed integrally with the narrow plate part 15*b*. The electric wire-pressure welding part 22 includes: a folded part 23 projectingly formed on a side surface 15*c* of the base plate 15 and folded in a U-turn-shape; a narrow connecting part 24 leading and crossing to the folded part 23 and piled on the base plate 15; a wide pressure welding piece 25 leading to front and rear ends of the connecting part 24 and bent to rise up perpendicularly to the base plate 15, the wide pressure welding piece 25 having a slot 25*a* for press-fitting the electric wire thereto; and a leg part 26 projectingly formed at a lower part of the pressure welding piece 25 so as to support the pressure welding piece 25 when an electric wire is press-fit thereinto. The projection length a of the leg part 26 is set approximately twice as large as the thickness t of the base plate 15. After the electric wire is press-fitted, an inner side surface 26*b* of the leg part 26 abuts against the side surface 15*c* of the base plate 15.

In the following, primary constitutional parts and their functions of the pressure welding terminal 10 and a pressure welding connector 30 in which the pressure welding terminals 10 are used will be explained. As for the pressure welding terminal 10, the explanation will be given mainly on the basis of FIG. 1 and partly on the basis of FIGS. 2–4. As for the pressure welding connector 30, the explanation will be given on the basis of FIGS. 5 and 6.

In this specification, for the sake of the explanation, a front-to-rear direction X, left-to-right direction Y and up-to-down direction Z are defined as follows: The front-to-rear direction X is the longitudinal direction of the pressure welding terminal 10, wherein the front side is the side of the electric contact 17 while the rear side is the side of the electric wire-pressure welding part 22. The left-to-right direction Y is the width direction of the base plate 15 or the projecting direction of the folded part 23 from the side surface 15*c* of the base plate 15 of the pressure welding terminal 10. The up-to-down direction Z is the rising-up direction of the pressure welding piece 25 or the thickness direction of the base plate 15.

Figure 1:
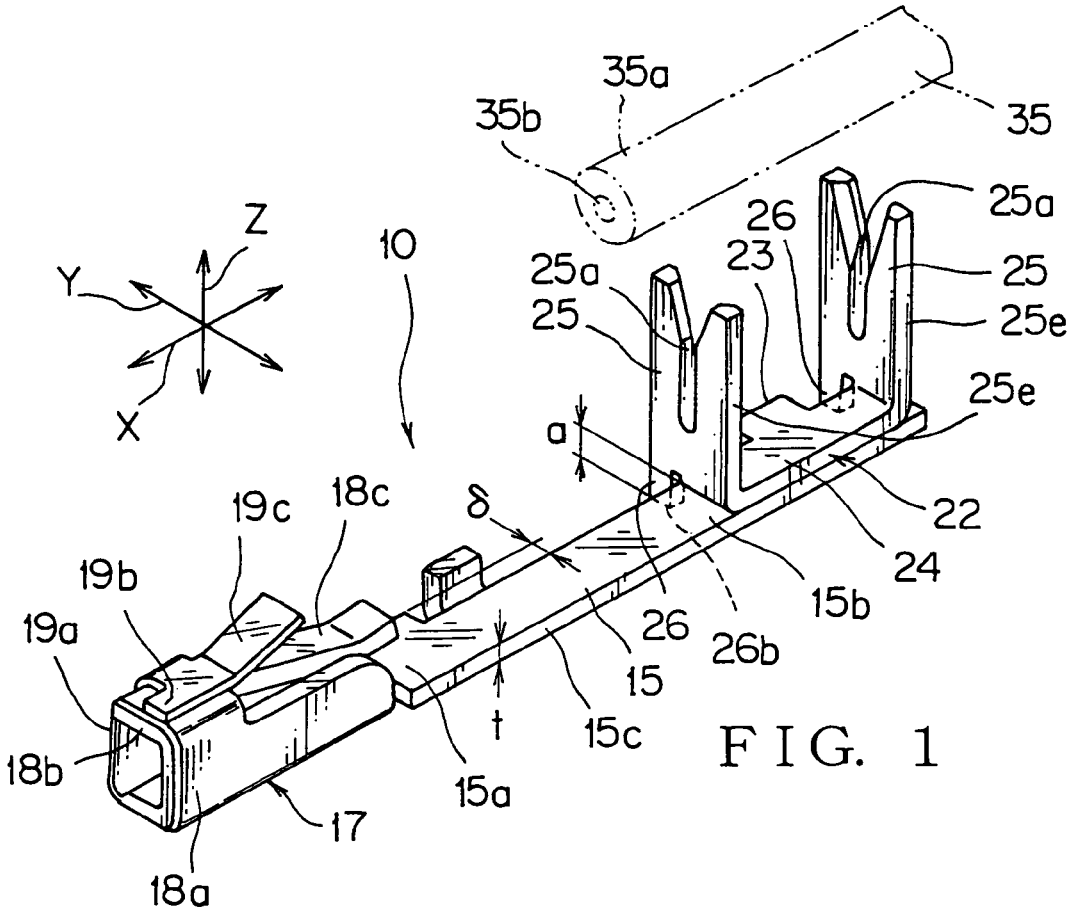
FIG. 1 is a perspective view illustrating a preferred embodiment of a pressure welding terminal according to the present invention.

As shown in FIG. 1, the pressure welding terminal 10 is formed by stamping out from an electrically conductive plate 13 (FIG. 4) having a uniform thickness such as copper alloy plate using a pressing machine and followed by bending. Each pressure welding terminal 10 is separated one by one from a continued band which is not shown in the figure. The electric contact 17 is integrally provided at the front side of the base plate 15 while the electric wire-pressure welding part 22 is integrally provided at the rear side of the base plate 15. The front side of the base plate 15 is the wide plate part 15*a* while the rear side of the base plate 15 is the narrow plate part 15*b* that leads to the wide plate part 15*a*. In a step δ between the wide plate part 15*a* and the narrow plate part 15*b,* the folded part 23 (explained later on) of the electric wire-pressure welding part 22 is situated, so that the folded part 23 is prevented from projecting toward the outside from the side surface of the wide plate part 15*a*. In this connection, it is possible to integrally form the electric wire-pressure welding part 22 on both sides of the pressure welding terminal 10 in the front-to-rear direction X, thereby allowing the pressure welding terminal 10 to function as a joint terminal.

The electric contact 17 is a constitutional component, into which a tab-shaped electric contact (not shown in the figure) of a mating terminal is inserted to achieve a terminal connection. The electric contact 17 is formed cylindrically including both side walls 18*a,* 19*a* rising-up vertically from the respective sides of the base plate 15 and top walls 18*b,* 19*b* piled up together by inwardly bending the end parts of the side walls 18*a,* 19*a* in parallel with the base plate 15. One top wall 18*b* is provided with a resilient contact piece 18*c* extending in the front-to-rear direction X while the other top wall 19*b* is provided with an engaging lance 19*c* extending in the front-to-rear direction X by a length shorter than that of the resilient contact piece 18*c*. In this connection, a male tab-shaped electric contact may be formed instead of the female electric contact 17.

The resilient contact piece 18*c* (FIG. 4) includes root part 18*d* leading to the top wall 18*b* and a free end part 18*e* leading to the root part 18*d* having the same width. The root part 18*d* is bent in a direction (downward direction) in which the root part 18*d* approaches the base plate 15 while an end of the free end part 18*e* is bent in a direction (upward direction) in which the end of the free end part 18*e* leaves away from the base plate 15, so that the resilient contact piece 18*c* (FIG. 2) is formed in a bending shape. A gap between the resilient contact piece 18*c* and the base plate 15 is defined taking a contacting pressure against the tab-shaped electric contact of a mating terminal into consideration. The upper part of the resilient contact piece 18*c* is a space for bending to allow a certain bending so as to hold the mating terminal resiliently. In this connection, the base plate 15 may be provided with a arch-shaped projection so as to hold an electric contact of a mating terminal between the projection and the resilient contact piece 18*c*.

Figure 2:
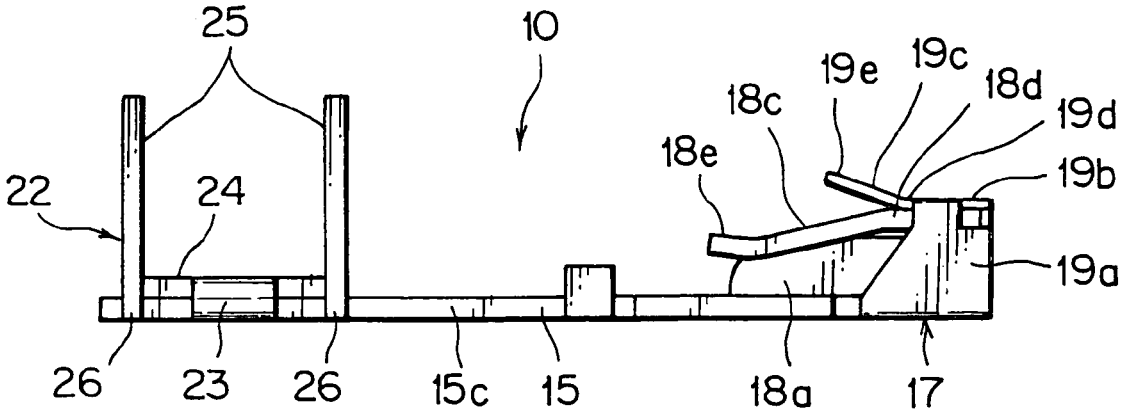
FIG. 2 is a side view of the pressure welding terminal shown in FIG. 1.

The engaging lance 19*c* includes a root part 19*d* leading to the top wall 19*b* and an engaging part 19*e* upwardly bent around the root part 19*d* (FIG. 2). An end of the engaging part 19*e* engages with a window of a connector cover (not shown in the figure) so as to prevent the pressure welding terminal 10 from coming out.

The electric wire-pressure welding part 22 is a constitutional component, the electric wire 35 being press-fit into the slot 25*a* of the electric wire-pressure welding part 22, thereby allowing the insulating coating 35*a* to be cut, so that the electric wire-pressure welding part 22 is electrically connected to the core wire 35*b*. The electric wire 35 is press-fit into the slot 25*a* by using a pressure welding blade of a pressure welding machine (not shown). An insertion resistance upon press-fitting of the electric wire varies depending on an opening angle θ (FIG. 4), cutting performance, and a distance of the slot 25*a*. In the preferred embodiment, the insulating coating 35*a* is smoothly cut without cutting the core wire 35*b* and the electric contact performance between the core wire 35*b* and an inner surface 25*d* of the slot 25*a* can be maintained even after the press-fitting of the electric wire.

The electric wire-pressure welding part 22 includes the folded part 23 projectingly formed on one side surface 15*c* of the narrow plate part 15*b,* the connecting part 24 crossing and leading to the folded part 23, the pressure welding piece 25 that leads to the front and rear ends of the connecting part 24, and the leg part 26 projectingly formed at the lower part of one side of the pressure welding piece 25.

Figure 3:
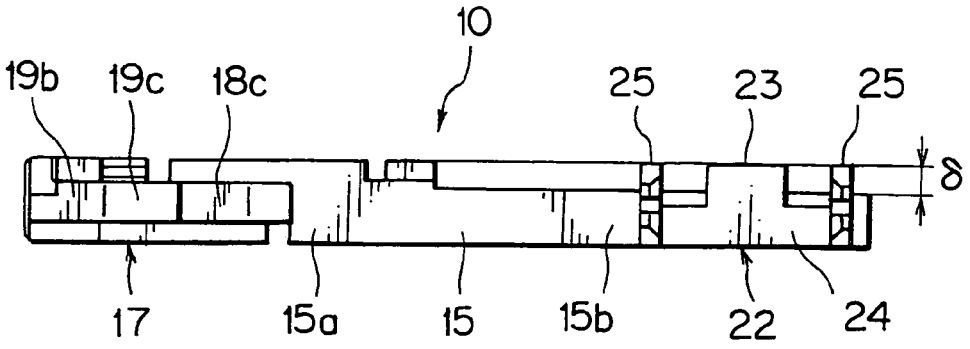
FIG. 3 is a plan view of the pressure welding terminal shown in FIG. 1.
Figure 4:
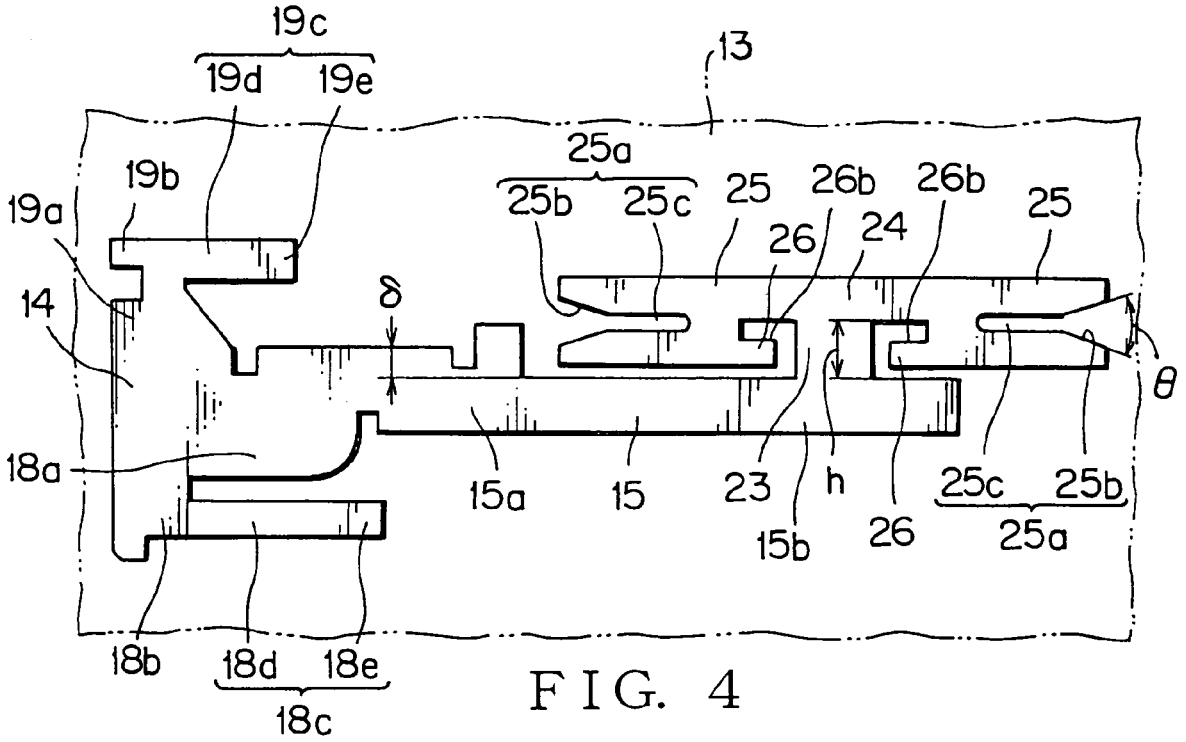
FIG. 4 is a development of the pressure welding terminal shown in FIG. 1.
Figure 8:
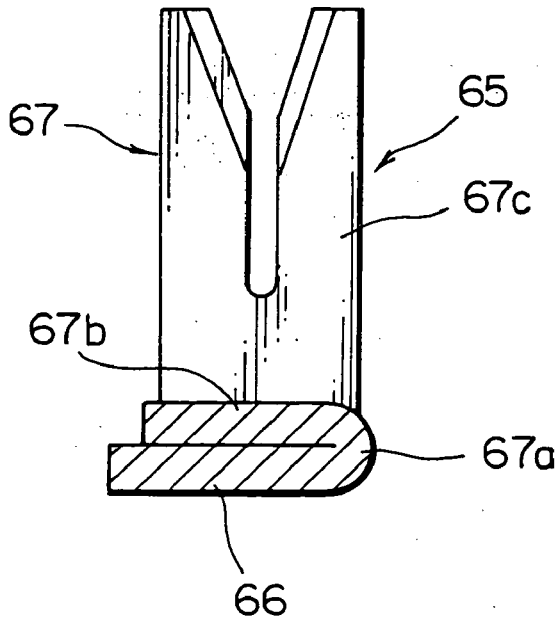
PRIOR ART FIG. 8
FIG. 8 illustrates another example of a conventional pressure welding connecting terminal.

The folded part 23 is folded by an angle of 180° in the left-to-right direction Y and is formed having approximately the same width as that of the base plate 15 (FIG. 4). The folded part 23 is formed having the projection length h in such a manner that a portion forced out from the side surface 15*c* upon the folding is within the step δ between the wide plate part 15*a* and the narrow plate part 15*b* of the base plate 15 (FIG. 3). Since the projection length h of the folded part 23 is formed in the narrow plate part 15*b* of the base plate 15, the folded part 23 can be formed long, so that an end of the connecting part 24 is prevented from displaced from a position of an edge of the base plate 15. To the contrary, as shown in FIG. 8, in the conventional example, such an undesirable displacement has taken place.

The connecting part 24 crosses at right angles and leads to the folded part 23. The connecting part 24 is piled on the base plate 15 by being bent from its spreading condition shown in FIG. 4. The length of the connecting part 24 in the front-to-rear direction is equal to the distance between two pressure welding pieces 25 situated at front and rear. The width of the connecting part 24 is formed narrower than that of the base plate 15 (FIG. 4) and approximately half of the width of the pressure welding piece 25. If the width of the connecting part 24 is too wide, the width of the leg part 26 projectingly formed at the lower part of the pressure welding piece 25 is forced to be narrow, causing a deterioration in the strength of the leg part 26. Further, the folded part 23 is forced to be short, causing the problem of the conventional example described above. On the other hand, if the width of the connecting part 24 is too narrow, the root part of the pressure welding piece 25 becomes weak, causing a deterioration in the bending stiffness, resulting in that the rising-up posture of the pressure welding piece 25 becomes unstable.

The pressure welding piece 25 is formed at both sides of the connecting part 24. The pressure welding piece 25 is raised up vertically by being bent inwardly from its spreading condition shown in FIG. 4. The pressure welding piece 25 includes a slot 25*a* consisting of a blade part 25*b* formed being opened at the end of thereof and a longitudinal groove 25*c* leading to the blade part 25*b*. The pressure welding piece 25 leads to the connecting part 24 at one side of its lower part. The leg part 26 is projectingly formed at the other side of the lower part of the pressure welding piece 25.

The blade part 25*b* has a given opening angle θ and is formed in a tapered shape. The blade part 25*b* cuts the insulating coating 35*a* leaving the core wire 35*b* of the electric wire 35 behind. The opening angle θ affects the insertion resistance of the electric wire 35 and is adjusted in such a manner that the insertion resistance is prevented from becoming too large and the cutting performance is not damaged. Preferably, for example, the opening angle θ is set to be from 20° to 60°.

The longitudinal groove 25*c* holds the core wire 35*b* of the electric wire 35. The depth of the longitudinal groove 25*c* is made in such a manner that the electric wire 35 press-fit in the longitudinal groove 25*c* does not come out therefrom. The gap of the longitudinal groove 25*c* is made a little narrower than the outer diameter of the core wire 35*b*. If the gap is too wide, the contact pressure is forced to be small, resulting in that the wire 35 may easily come out. On the other hand, if the gap is too narrow, the insertion resistance of the wire 35 becomes large.

The projection length a of the leg part 26 (FIG. 1) is made to be approximately twice as large as a thickness t of the base plate 15. If the projection length a is too long, the pressure welding terminal 10 is forced to be inserted into the terminal-receiving groove 32 of the connector housing 31 shown in FIG. 5 in its inclined posture, resulting in that the seating of the pressure welding terminal 10 tends to be unstable and the rising-up posture of the pressure welding piece 25 becomes unstable. On the other hand, if the projection length a is too short, the bottom surface of the leg part 26 fails to abut against the bottom wall of the terminal-receiving groove 32 upon the press-fitting of the wire 35, resulting in that the leg part 26 cannot support the pressure welding piece 25. That is, the projection length a of the leg part 26 is made to be approximately twice as large as a thickness t of the base plate 15, so that the pressure welding piece 25 is supported by the leg part 26, the pressure welding piece 25 is prevented from being deformed, the rising-up posture of the pressure welding piece 25 is stabilized, and the wire 35 can be press-fit on a condition that the pressure welding piece 25 is not inclined.

The inner side surface 26*b* of the leg part 26 is an abutting surface to abut against the side surface 15*c* of the base plate 15 upon the press-fitting of the wire 35. That is, when the wire 35 is press-fit into the slot 25*a,* the slot 25*a* opens outwardly, the leg part 26 is bent inwardly due to a principle of a lever around the lower part of the slot 25*a,* and the inner side surface 26*b* of the leg part 26 abuts against the side surface 15*c* of the base plate 15 (FIG. 6). When the leg part 26 abuts against the base plate 15, the slot 25*a* is prevented from opening further, the core wire 35*b* is strongly held by the slot 25*a,* thereby maintaining the reliability of preventing the core wire 35*b* from coming out and the reliability of the pressure welding connection.

FIG. 4 is a development illustrating a preferred embodiment of a method of producing the pressure welding terminal 10. This method includes: a stamping step in which an electrically conductive plate 13 made of, for example, a plate of copper alloy is stamped out in a specific shape with a press-machine having a punch and die; and a bending step.

In the stamping step, a plurality of terminal blanks 14 are stamped out from the electrically conductive plate 13 in a state that a plurality of terminal blanks 14 are laterally linked to a belt-shaped linked belt. The stamped-out terminal blanks 14 are wound up around a reel (not shown) and then subjected to the bending step. In the bending step, each terminal blanks 14 in its spreading condition is bent in turn so as to form the pressure welding terminal 10. The terminal blanks 14 wound around the reel are forwarded in the lateral direction with a specific pitch having a transfer hole formed on the linked belt as a reference, so that the terminal blanks 14 are fed in turn to a press-machine of the bending step.

The terminal blank 14 fed to the press-machine of the bending step is bent from the side wall 18*a* that constitutes the electric contact 17 having the base plate 15 as a reference surface, then the other side wall 19*a* is bent so as to form the rectangular cylindrical electric contact 17.

Thereafter, the electric wire-pressure welding part 22 is formed. First, the folded part 23 projectingly formed on the side surface 15*c* of the base plate 15 is folded by an angle of 180° and the connection part 24 is bent so as to overlap with the base plate 15 precisely. Then, the pressure welding pieces 25 continuously formed at front and rear ends of the connecting part 24 are bent inwardly in turn and raised up vertically from the base plate 15. The leg part 26 projectingly formed at the lower part of the pressure welding piece 25 is placed in a step δ between the wide plate part 15*a* and narrow plate part 15*b* of the base plate 15. Then, the pressure welding terminals 10 are separated from the linked belt one by one so that each pressure welding terminal 10 as one body shown in FIG. 1 can be obtained.

As shown in FIGS. 5 and 6, the pressure welding terminal 30 includes the connector housing 31 and the pressure welding terminals 10 shown in FIG. 1. The connector housing 31 is made by molding resin and has a plate-shape. In the connector housing 31, there are provided a plurality of terminal-receiving grooves 32 in parallel partitioned by a partition wall 33 from one another. The pressure welding terminal 10 is received into the corresponding terminal-receiving groove 32 in a state that the pressure welding piece 25 is set facing upward and the outer side surface 25*e* of the pressure welding piece 25 abuts against the partition wall 33.

Since the outer side surface 25*e* of the pressure welding piece 25 abuts against the partition wall 33, the slot 25*a* is prevented from opening when the wire 35 is press-fit into the slot 25*a,* thereby securing the contact pressure and improving the reliability of the pressure welding connection. Further, the wire holding force can be maintained so as to prevent the wire 35 from coming out.

According to the preferred embodiments described above, since the pressure welding piece 25 having no side wall is formed on the base plate 15, therefore the width of the pressure welding piece 25 becomes the width of the pressure welding terminal 10, resulting in that the electric wire-pressure welding part 22 can be made compact, that is, the pressure welding terminal 10 can be made compact. Since the folded part 23 of the electric wire-pressure welding part 22 is placed in the step δ between the wide plate part 15*a* and narrow plate part 15*b* of the base plate 15, the folded part 23 can be formed long. Further, the folded part 23 projects outwardly in the width direction of the base plate 15, therefore the width of the electric wire-pressure welding part 22 can be prevented from increasing, that is, the width of the pressure welding terminal 10 can be prevented from increasing. Since the leg part 26 that supports the pressure welding piece 25 is projectingly formed at the lower part of the pressure welding piece 25, the pressure welding piece 25 can be prevented from being deformed, such as from buckling or being inclined upon press-fitting of the electric wire. When such pressure welding terminals 10 are received in a multipolar connector, a compact connector can be attained.

The aforementioned preferred embodiments are described to aid in understanding the present invention and variations may be made by one skilled in the art without departing from the spirit and scope of the present invention.

What is claimed is:

1. A pressure welding connecting terminal, which integrally includes an electric wire-pressure welding part at least at one side of the terminal in a longitudinal direction of a base plate of the terminal, the electric wire-pressure welding part comprising:

a folded part projectingly formed on a side surface of the base plate and folded in a U-turn-shape;

a narrow connecting part leading to the folded part and piled on the base plate;

a wide pressure welding piece leading to at least one of a front end and a rear end of the connecting part and bent to rise up perpendicularly to the base plate; and a leg part projectingly formed on the same side as the folded part at a lower part of only one side of the wide pressure welding piece.

2. The pressure welding connecting terminal according to claim 1, wherein the projection length of the leg part is approximately twice as large as a thickness of the base plate.

3. A pressure welding connector comprising:

the pressure welding connecting terminal according to claim 1; and a connector housing for receiving the pressure welding connecting terminal.

4. A pressure welding connecting terminal which integrally includes an electric wire-pressure welding part at least at one side of the terminal in a longitudinal direction of a base plate of the terminal, the electric wire-pressure welding part comprising:

a folded part projectingly formed on a side surface of the base plate and folded in a U-turn-shape;

a narrow connecting part leading to the folded part and piled on the base plate;

a wide pressure welding piece leading to at least one of a front end and a rear end of the connecting part and bent to rise up perpendicularly to the base plate; and a leg part projectingly formed at a lower part of the pressure welding piece so as to support the pressure welding piece when an electric wire is press-fit thereinto;

wherein the base plate includes a wide plate part and a narrow plate part, and wherein the electric wire-pressure welding part is formed on the narrow plate part.

5. A pressure welding connecting terminal which integrally includes an electric wire-pressure welding part at least at one side of the terminal in a longitudinal direction of a base plate of the terminal, the electric wire-pressure welding part comprising:

a folded part projectingly formed on a side surface of the base plate and folded in a U-turn-shape;

a narrow connecting part leading to the folded part and piled on the base plate;

a wide pressure welding piece leading to at least one of a front end and a rear end of the connecting part and bent to rise up perpendicularly to the base plate; and a leg part projectingly formed at a lower part of the pressure welding piece so as to support the pressure welding piece when an electric wire is press-fit thereinto;

wherein an inner side surface of the leg part abuts against the side surface of the base plate.

6. A pressure welding connector comprising:

a pressure welding connecting terminal and a connector housing for receiving the pressure welding connecting terminal, said terminal integrally including an electric wire-pressure welding part at least at one side of the terminal in a longitudinal direction of a base plate of the terminal, the electric wire-pressure welding part comprising:

a folded part projectingly formed on a side surface of the base plate and folded in a U-turn-shape;

a narrow connecting part leading to the folded part and piled on the base plate;

a wide pressure welding piece leading to at least one of a front end and a rear end of the connecting part and bent to rise up perpendicularly to the base plate; and a leg part projectingly formed at a lower part of the pressure welding piece so as to support the pressure welding piece when an electric wire is press-fit thereinto, wherein both outer side surfaces of the pressure welding piece of the pressure welding connecting terminal abut against a partition wall of a groove for receiving the terminal.

* * * * *